US008201488B1

(12) United States Patent
Daniels et al.

(10) Patent No.: US 8,201,488 B1
(45) Date of Patent: Jun. 19, 2012

(54) CONFORMABLE SELF-HEALING BALLISTIC ARMOR

(75) Inventors: George A. Daniels, Waterford, MI (US); Paul A. Petrovich, Fowlerville, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/114,927

(22) Filed: May 24, 2011

Related U.S. Application Data

(63) Continuation of application No. 11/879,519, filed on Jun. 28, 2007, now Pat. No. 7,966,923.

(51) Int. Cl.
*F41H 7/00* (2006.01)

(52) U.S. Cl. ..... 89/36.02; 89/917

(58) Field of Classification Search ..... 89/36.01–36.08, 89/36.11; 2/2.5
See application file for complete search history.

(56) References Cited

U.S. PATENT DOCUMENTS

| | | | | | |
|---|---|---|---|---|---|
| 3,431,818 | A * | 3/1969 | King | 89/36.02 |
| 3,523,057 | A * | 8/1970 | Buck | 428/156 |
| 3,705,558 | A * | 12/1972 | McDougal et al. | 109/84 |
| 4,538,301 | A * | 9/1985 | Sawatzki et al. | 2/467 |
| 4,623,592 | A * | 11/1986 | Daude et al. | 428/423.7 |
| 4,665,794 | A * | 5/1987 | Gerber et al. | 89/36.02 |
| 4,850,260 | A * | 7/1989 | Walker et al. | 89/34 |
| 5,110,661 | A * | 5/1992 | Groves | 428/178 |
| 5,738,925 | A * | 4/1998 | Chaput | 428/101 |
| 5,906,873 | A * | 5/1999 | Kim | 428/57 |
| 6,016,735 | A * | 1/2000 | Langner | 273/410 |
| 6,138,275 | A * | 10/2000 | Sacks | 2/2.5 |
| 6,200,664 | B1 * | 3/2001 | Figge et al. | 428/178 |
| 2006/0065111 | A1 * | 3/2006 | Henry | 89/36.02 |

* cited by examiner

*Primary Examiner* — Bret Hayes
*Assistant Examiner* — Reginald Tillman, Jr.
(74) *Attorney, Agent, or Firm* — David L. Kuhn; Thomas W. Saur; Luis Miguel Acosta

(57) ABSTRACT

A conformable self-healing ballistic armor protective structure has a shell formed of a laminated cloth material having outer and inner lamellae. The outer lamella of the laminated material is a ballistic cloth and the inner lamella is a soft, conformable self-healing, rubber compound. The shell is filled preferably with multiplicity of ceramic particles disposed in a fluid.

20 Claims, 1 Drawing Sheet

CONFORMABLE SELF-HEALING BALLISTIC ARMOR

CROSS-REFERENCE TO RELATED APPLICATIONS

This application is a continuation of U.S. patent application Ser. No. 11/879,519, which is U.S. Pat. No. 7,966,923, filed on Jun. 28, 2007.

GOVERNMENT INTEREST

The invention described herein was made by employees of and is assigned to the United States Government.

BACKGROUND OF THE INVENTION

In one aspect this invention relates to ballistic armor structures. More particularly, this invention relates to a ballistic armor which is conformable to a wide variety of vehicles or structures.

The use of ceramics and ballistic cloth as part of ballistic protective armor systems is well-known because of the light weight of these materials as compared to steel and other solid metallic armor. Ceramics are distinguished by a high hardness and very rigid structure. When used for ballistic protection, it is essential that the ceramic chosen be able to withstand the substantial shock load caused by an incident projectile and yet have some deformation protection. A typical ceramic armor structure has a ceramic material on its outer surface designed to withstand the shock of an incoming projectile. It is common to provide a fibrous or metal backing material behind the ceramic to support and withstand the deformation of the ceramic as it is impacted. In such a structure, the ceramic component will exhibit brittle breaking behavior. When the ceramic material receives a focused strike which initiates a crack, the ceramic material will undergo continuous cracking or crazing throughout its contiguous volume. Thus, a ceramic piece is effectively destroyed over its contiguous volume when struck by a projectile having sufficient energy to initiate cracking.

This problem is ameliorated by reducing the size of the contiguous portions of the ceramic, as by mounting small ceramic segments or plates over the entire face of the flexible backing material. This will minimize the surface area left unprotected when a single segment or plate is destroyed. Generally, for smaller sized vehicles, such as light trucks, ceramic plates on the order of 1 square inch have been found to provide a high degree of protection. Use of such small plates minimizes the damage to the overall structure from the incursion of an individual projectile and the associated destruction of one or two plates. Thus, multiple projectiles can be stopped by such a mosaic structure of ceramic segments or plates, the remaining danger being when numerous rounds repeatedly strike the same small area. For larger vehicles such as military combat vehicles, larger ceramic segments or tiles, of a size on the order of 2-3 square inches, provide effective protection from the larger projectiles normally faced by such vehicles. In such bigger vehicles, the larger ceramic tiles are generally thick enough to withstand multiple smaller projectiles without losing integrity.

While ceramic materials provide extremely good protection, the production of such protective mosaic structures, made up of such small ceramic segments or tiles, is extremely costly. Thus ceramics alone are not feasible as a protective means for a large surface in most applications. Furthermore, such structures are produced as plate mosaics, i.e., shaped collections of smaller ceramic tiles sized and shaped to overlay specific vehicle areas while mating with specific edges of complementary armor sections. Thus, such plate mosaics must be manufactured to a rigidly predetermined shape. This makes it difficult or impossible to transfer or otherwise remove armoring plate mosaics from one vehicle and place this armor on a vehicle other than the vehicle type for which a particular plate mosaic was manufactured.

There are a number of considerations to be examined when generating a ballistic structure, especially for mobile applications. A primary consideration is weight. Protective ballistic armor for heavy, mobile military equipment, such as tanks or large ships is a well developed art. Such armor usually comprises a very thick layer of alloy steel which provides protection against most heavy and explosive particles. Such vehicles or vessels are frequently capable of selectively adding further armor protection when they are deployed in combat zones. If such armor protection can be made more effective, the weight of the heavy armor could be reduced while still allowing the armor to defeat projectiles of comparable threat levels. Reduction of armor weight, even for heavy equipment supplied with large prime movers, is an advantage since it reduces the strain on all vehicle components and reduces operating costs. For these same reasons, current heavyweight armor is also less desirable for the light weight tactical vehicles which form the majority of any military vehicle fleet. Performance of tactical vehicles, such as heavy trucks, light trucks, and support vehicles is substantially compromised by steel panels having a thickness of more than a few millimeters because of the extreme weight each millimeter of steel armor adds to vehicle weight. For example, in the case of a light truck, steel armor sufficient to stop rifle projectiles can degrade performance on a hill grade to such an extent that the truck can only achieve the speed of a person walking.

Despite such shortcomings, armor for light vehicles is expected to prevent penetration from the threats posed by the common 7 mm military rifles and shrapnel from improvised explosive devices. In today's modern warfare, armor piercing projectiles even from military rifles represent a substantial threat and would require a relatively thick steel armor, typically of more weight than a light vehicle can carry.

Another consideration for military vehicles is cost. Overly complex armor arrangements, particularly those that depend upon laminated synthetic fibers consolidated using sophisticated resins and manufacturing techniques, can make manufacture of armor prohibitively expensive for large fleets of small vehicles.

A third consideration in armor design is adaptability; most ceramic and metal armors are essentially flat rigid plates and have little, if any, conformability. Manufacture of complex or conformable shapes using metal or laminated fibers which allow the resulting armor sub-components to be inserted into existing voids in a vehicle is nonexistent.

Yet another consideration in ceramic structures is the fact that ceramic plates are brittle and subject to fracture in handling and manufacturing which results in waste and additional cost.

It is an object of this invention to provide a conformable, self-healing ballistic structure which is effective against standard military projectiles and which can be readily attached to more than one type of vehicle.

It is a further object of the invention to provide a ballistic panel which is effective in resisting a plurality of projectiles impacting on the same general area.

SUMMARY OF THE INVENTION

The present invention comprises a conformable, self-healing ballistic armor protective structure which is formed as a laminated casing or shell with at least two layers. The laminated shell is made with an outer layer of a ballistic material or cloth designed to provide penetration resistance. The laminated container of the ballistic armor has a second, inner layer of a soft, self-healing plastic material. The inner layer is designed to allow any openings formed by projectile incursion to close so as to retain a filler material within the container.

The present ballistic structure's container or shell is formed to surround a tillable void or pocket into which is placed filler material. The filler material is designed to aid in shock absorption or detention of projectiles upon their incursion into the ballistic structure. Materials for suitably filling the pocket formed by the shell may include various particulate and/or fluidic materials.

DETAILED DESCRIPTION

Figure 1:
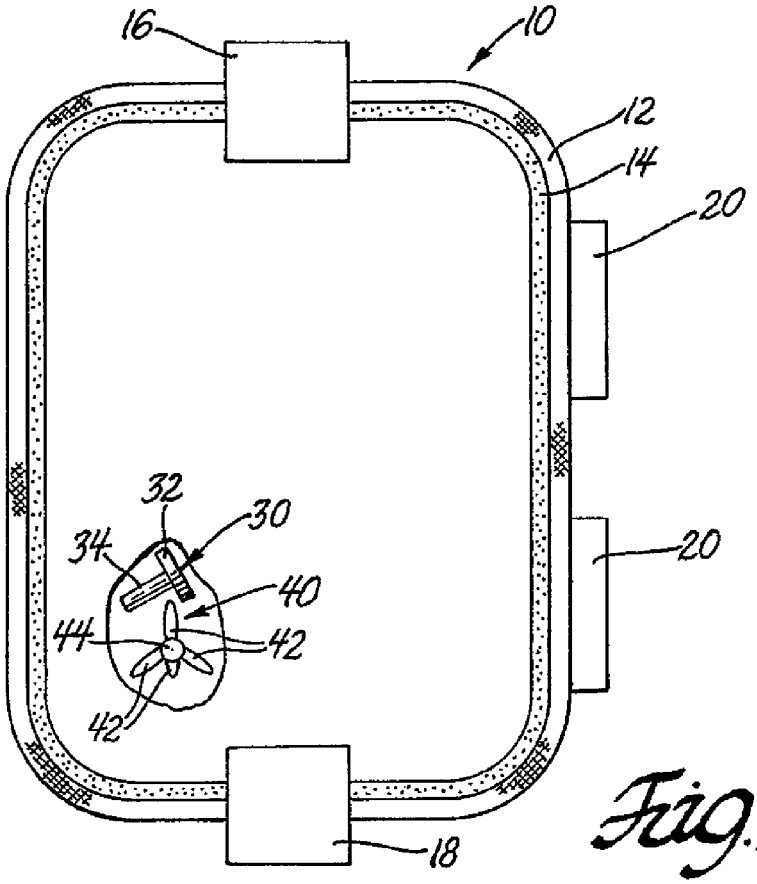
FIG. 1 is a side view of a unit of the ballistic structure according to this invention.

Referring to the accompanying drawing in which like numerals refer to like parts, and initially to FIG. 1, a conformable, self-healing ballistic armor protective structure is shown. The particular configuration of one unit of the ballistic armor shown in FIG. 1 has a laminated casing or shell 10 forming a pocket, with a fillable void, of generally rectangular cross-section. It is to be understood, however, that one object this invention is to provide ballistic armor comprising an array of multiple units of laminated casings 10, each of which is conformable. Thus, the device, being comprised of multiple units of the individual filled shells, can be shaped to various configurations to fit into various vehicle compartments or to fit comformably onto various vehicle surfaces. One or more suitably sized units of shell 10 could even be placed between panels of a vehicle, such that when each shell 10 is filled, the one or more shells would adapt to fill the surrounding space.

The casing or shell 10 of the subject invention is preferably formed as hollow, fillable units suitably sized for use in an arrayed plurality of panels of shells 10 to cover a vehicle or fill a void vehicle compartment. As shown in FIG. 1, the casing or shell 10 comprises a multilayered ballistic material with at least one outer layer of ballistic material 12 and a self-healing inner layer 14. A fillable void formed within inner layer 14 is filled with a filler material 15, as detailed below.

More specifically, shell 10 comprises a flexible laminate of two lamellae 12 and 14, with the outer lamella 12 being chosen from materials that provide ballistic protection from projectiles such as small arms fire and shrapnel. Generally, this layer 12 would be formed of a ballistic cloth of synthetic fibers known for their resistance to projectiles. Such cloth may incorporate "Kevlar" or similar aramid-containing polymeric materials. Instead of or in addition to such materials, heavy tear resistant polyester, glass, polyamide, ballistic nylon and similar fabrics can be used, either in combination as fibers or as part of a multi-layered cloth.

In the embodiment shown in FIG. 1, the shell 10 of the present structure has only two lamellae 12 and 14; however, it is understood that multiple layers of material having different ballistic resistant qualities and self-healing properties could be combined into a multi-layered structure to provide enhanced protection. A multilayered cloth would have different layers, 12, 14 and possibly more, being chosen for complementary properties such as ballistic resistance, chemical resistance, flame retardancy and flexibility. For example, it may be desirable to have a third, outermost layer with increased wear and scratch resistance on the face of the shell 10, to provide a covering which protects a more ballistically active layer, such as Kevlar.

To increase fabric resistance to leakage of fillers under normal operating conditions, the cloth, comprising lamellae 12 and 14 and possibly other lamellae, can be coated with various fluid impermeable materials such as polyvinyl chloride, polyurethane, or neoprene. The multilayered fabrics, whether coated or uncoated, may be chosen for the degree of flexibility so that they can be rolled, folded or otherwise collapsed when empty, for storage or transportation to the area where the panel is to be attached or used. In addition to fluid impermeable coatings, the outer surface of the lamella 12 or of another outer layer of the ballistic cloth could be coated with electromagnetic energy absorbing materials which would reduce the radar or thermal signature of the ballistic fabric. Other coatings might include camouflage, nuclear, or biological protective or flame retardant coatings, depending on the expected conditions in which the vehicle is to operate.

The inner, self-healing layer 14 of the laminated casing or shell 10 of the present structure would generally be a soft, conformable, self-healing rubber type compound or a soft, self-healing plastic material. Such compounds have good cohesive structure in that they tend to adhere to themselves, such that when a projectile passes through the inner layer 14 into the filled interior of a unit 10 of the ballistic structure, any hole will tend to close rapidly behind the projectile. This helps contain any fluid or particulate material 15 within the pocket formed by inner layer 14 of the shell 10. Natural rubbers and similar thermoplastic materials, i.e., ethylene propylene diene monomer, and polyurethane materials, such as Tyreliner, represent possible filler materials 15 useful for filling the pocket in self-healing layer 14. The soft self-healing layer 14 also could be covered by or incorporate a scrim or other fibrous reinforcing material which would help consolidate and hold the self-healing layer 14 in position.

The laminated shell 10 is shown with a selectively closable filler opening 16 located near the top of the shell which allows the filling material 15 to be placed into the pocket or void formed by layer 14 of shell 10, filling the internal volume and providing additional ballistic resistance. A closable filler opening 16 comprising a threaded wide mouth aperture with a threaded stopper would be sufficient to provide the kind of access required by this invention and further description of such commonly known selectively sealable openings is omitted in the interest of brevity. As shown, the ballistic armor structure also has a second, selectively closable aperture 18 located near the bottom of the casing 10 which could be used for draining or otherwise removing the filler 15 from the inner layer 14, allowing the shell 10 to be collapsed and folded for storage and/or transportation. Obviously, only a single selectively closable opening is necessary to allow filler material 15 to be added or removed selectively from the shell 10, but a second opening located in a lower position on shell 10 may facilitate and speed such operation.

In an alternative embodiment of the subject invention, the inner layer 14 may be manufactured without a selectively closable opening, such that the filler material 15 is placed within the pocket formed within layer 14 on a one time basis at the time of fabrication.

Each unit of shell 10 of the ballistic armor of the subject invention further comprises fastening means 20 to attach each such shell 10 to the vehicle to be armored. In the preferred embodiment shown in FIG. 1, fastening means 20 of the shell 10 comprises one fastener half of a hook and loop fastener combination attached on one side of the casing 10. Where fastening means 20 is such a fastener half, it can be used in combination with the mating complementary fastener half attached on a vehicle, structure or other area to be protected, to hold the shell 10 in position. The hook and loop fastener, an easily manufactured device commercially available as "Velcro," provides a lightweight mounting system useful in holding ballistic protection devices on the sides of vehicles or buildings. Other fastening means 20 well known to the fastening art, such as clipping, bolting and the like, would also be suitable for selectively affixing the conformable ballistic armor to the vehicle is a secure manner, both on a temporary or permanent basis.

The ballistic armor of this invention may have one or more filler materials 15 which may be comprised of either a solid and/or liquid material. Solid fillers 15 useful in the practice of this invention will generally be comprised of uniform, shaped particles. The particles could be metallic, plastic, glass or ceramic compositions. Each particle composition will have different resistance properties to the incursion of a projectile. Ceramics provide a quality of abrasive, high resistance to projectiles at a relatively light weight; thus, they represent a preferred particle composition for a filler material 15. Suitable ceramic materials would include alumina, as well as various metal aluminates and silicates. Silicon carbides and silicon nitrites would also be acceptable ceramic materials; however, these materials tend to be extremely expensive and it is believed that aluminates and silicates would be preferred materials for use as filler 15.

Generally, prior art ceramic particles have been rounded or spherical in nature. The particles contemplated to comprise filler 15 in one preferred embodiment of this invention will have two or more projections or arms extending outward so that the shaped particles will interlock with adjoining shaped particles to resist displacement upon the incursion of a projectile. In the preferred embodiment shown in FIG. 1, the particles having two or more outwardly extending projections or arms will be of a multiplicity of shapes, shown here to include both T-shaped particles and caltrop-shaped particles, as further described below.

Figure 2:
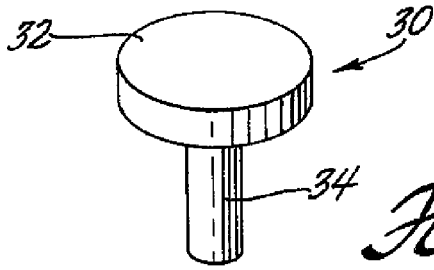
FIG. 2 is a perspective view of one structure of a filler particle useful in the practice of this invention.
Figure 3:
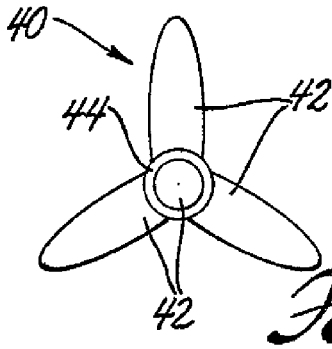
FIG. 3 is a top plan view of a second structure of a filler particle useful in the practice of this invention.

FIGS. 2 and 3 each show a different ceramic structure for the particles comprising filler 15 that is useful in the practice of this invention. FIG. 2 shows a T-shaped ceramic particle 30 having a substantially rounded or elongated head 32 and a leg 34 extending perpendicular to the head. Such a T-shaped structure preferably has a leg 34 that is slightly longer than the diameter of the head 32. The resulting plurality of such particles will pack in a random, interlocking fashion and will interlock with neighboring particles so as to resist movement by a penetrator once the particles fill the void volume of lamella 14 and are settled into position.

FIG. 3 shows a particle structure comprising a caltrop particle configuration 40 with four arms 42 extending outward from a center portion 44, the arms 42 terminating at what would be the vertices of a regular tetrahedron. A caltrop particle structure 40 provides a particularly good three-dimensional structure wherein the legs 42 of the shaped particles will be in an interference relationship with a maximum number of surrounding particles nearest an individual particle to maximize the interference relationship of the particles and increase the resistance to penetrating projectiles.

In addition to or instead of containing particles, the laminated shell 10 may contain a liquid or gel material as filler material 15. Depending on the threat to be defeated, the ballistic fabric of lamella 12 may provide the majority of antiballistic protection needed, and the liquid or gel material of filler 15 can provide additional protection as well as filling the shell to its desired configuration. When used in a vehicle cavity, a liquid filler 15 will cause the shell 10 to conform to and fill the cavity. In the simplest case the interior of the present casing 10 can be filled with a fluid filler 15 such as water or other relatively fluid liquid material which will disburse shock and hold the projectile once it enters the structure. Where additional absorptive capacity is necessary, a dilatant gel would make excellent filler 15. Such dilatant gels flow freely and conform readily under normal conditions. However, when they are subjected to a shock force, they resist movement and absorb additional energy. One example of a commercially available dilatant compound is Dow Corning 3179 Dilatant Compound, a commercially available siloxane with fillers.

The addition of fire or flame retardant type materials to the filler material 15, whether the chosen filler 15 be particulate, liquid, gel or some combination of these, would be beneficial to the present invention. Such materials would suppress fire damage by projectiles which tend to cause fires when they strike a target. Having flame retardantcy either in the filler 15 or in the outer ballistic fabric 12 will provide additional protection for a vehicle's occupants.

In a preferred embodiment, the filler material 15 used in the subject conformable self-healing ballistic structure of the subject invention, would comprise both types of filler materials, such that the shaped ceramic particles described above would be disposed in a dilatant gel within layer 14 of each casing 10. The resulting structure would have a gel surrounding the uniform ceramic particles and filling the void volume left between the solid particles. The combination of gel and ceramic particles results in an enhanced filler 15 wherein the gel provides a lubricating quality allowing close particle packing within the structure, and provides an expansion resistant force to hold the particles in position when a projectile intrudes. The gel provides a stabilizing matrix material which will maximize the resistance of the particles to physical separation, thus increasing the resistance of the particles to the projectile, while allowing the solids to reassume their packed interlocking position once the projectile is stopped. Also, the gel will provide a stabilizing medium should the shaped ceramic particles become broken or crushed by the incursion of projectiles. The resulting stabilized ceramic laden gel will be highly abrasive, and thus resistant to projectiles, allowing the structure to continue to defeat projectiles, even after an initial projectile volley is sustained by the ballistic structure.

Various alterations and modifications will become apparent to those skilled in the art without departing from the scope and spirit of this invention and it is understood this invention is limited only by the following claims.

What is claimed is:

1. A conformable, self healing ballistic armor comprising:

a laminated shell having an outer layer of ballistic material and a self-healing inner layer, the inner layer having a pocket therein; and a filler material within the pocket formed within the inner layer, the filler material being a flowable dilatant material that conforms to the shape of the laminated shell, said dilatant flowing freely in the absence of a shock force but providing energy absorption and resistance to movement when subjected to a shock force, the filler material further including solid particles shaped as T-shaped particles, said T-shaped particles comprising outwardly extending projections that interlock with respective projections of adjoining T-shaped particles to resist displacement upon the incursion of a projectile.

2. The armor of claim 1 wherein said ballistic material is a ballistic cloth of a woven polyaramid fiber.

3. The armor of claim 1 wherein the shell further comprises at least one selectively closable opening, whereby the filler material may be added or removed from the shell.

4. The armor of claim 1 wherein the dilatant gel contains fire retarding materials.

5. The armor of claim 1 wherein said T-shaped particles include a head and a leg extending perpendicular to the head.

6. The armor of claim 5 wherein said head of said T-shaped particles is substantially rounded.

7. The armor of claim 6 wherein said leg is slightly longer than the diameter of said head.

8. The armor of claim 5 wherein said head of said T-shaped particles is elongated.

9. The armor of claim 1 wherein the shell further comprises means to attach the shell to a vehicle body.

10. The armor of claim 9 wherein said attachment means comprising one or more bolts.

11. The armor of claim 9 wherein the attachment means is a hook and loop fastener, comprising one half of the hook and loop fastener combination disposed on the shell and the other, complementary half of the hook and loop fastener combination disposed on the vehicle body.

12. The armor of claim 9 wherein the attachment means is an adhesive.

13. A conformable self-healing ballistic armor structure comprising:

a shell formed of a laminated ballistic cloth material having an outer lamella and an inner lamella, the shell having at least one sealable filler opening, the outer lamella being a woven polyaramid ballistic cloth and the inner lamella being a soft, conformable self-healing layer selected from one of either a self-healing rubber compound or a soft, self-healing plastic material, the inner lamella forming a fillable pocket therein;

a filler comprising a multiplicity of shaped particles disposed in a flowable fluid filling the pocket within said inner lamella, the shaped particles each having at least two projections adapted to interact with adjoining particles in an interfering manner so as to inhibit movement of the particles relative to each other upon the incursion of a projectile into the pocket by virtue of the interaction of the projections of adjoining particles, at least one or more of said multiplicity of shaped particles being shaped as T-shaped particles, and the fluid being a dilatant gel that surrounds the particles and fills the void volume left by the solid particles within the pocket of the inner lamella, so as to maximize the resistance of the particles to separate and increase the resistance of the particles to the projectile while allowing the solids to reassume their packed interlocking position once the projectile is stopped.

14. The armor of claim 13 wherein the shell further comprises at least one selectively closable opening, whereby the filler material may be added or removed from the shell.

15. The armor of claim 13 wherein said filler material is a dilatant gel.

16. The armor of claim 13 wherein the dilatant gel contains fire retarding materials.

17. The armor of claim 13 wherein the outer and inner lamellae are coated with one or more fluid impermeable materials.

18. The armor of claim 13 wherein said T-shaped particles include a substantially rounded head and a leg extending perpendicular to the head.

19. The armor of claim 18 wherein said leg is slightly longer than the diameter of said substantially rounded head.

20. A conformable self-healing ballistic armor structure comprising:

a shell formed of a laminated ballistic cloth material having an outer lamella and an inner lamella, the shell having at least one sealable filler opening, the outer lamella being a woven polyaramid ballistic cloth and the inner lamella being a soft, conformable self-healing layer selected from one of either a self-healing rubber compound or a soft, self-healing plastic material, the inner lamella forming a fillable pocket therein;

a filler comprising a multiplicity of shaped particles disposed in a flowable fluid filling the pocket within said inner lamella, the shaped particles each having at least two projections adapted to interact with adjoining particles in an interfering manner so as to inhibit movement of the particles relative to each other upon the incursion of a projectile into the pocket by virtue of the interaction of the projections of adjoining particles, at least one or more of said multiplicity of shaped particles being shaped as caltrop shaped particles and at least one or more of said multiplicity of shaped particles shaped as T-shaped particles, and the fluid being a dilatant gel that surrounds the particles and fills the void volume left by the solid particles within the pocket of the inner lamella, so as to maximize the resistance of the particles to separate and increase the resistance of the particles to the projectile while allowing the solids to reassume their packed interlocking position once the projectile is stopped.

* * * * *